United States Patent [19]

Hall

[11] Patent Number: 4,673,372

[45] Date of Patent: Jun. 16, 1987

[54] ROTARY DEVICE

[76] Inventor: Carlton Hall, 233 Broadway RM 3615, New York, N.Y. 10007

[21] Appl. No.: 789,450

[22] Filed: Oct. 21, 1985

[51] Int. Cl.[4] ..... A63H 1/02

[52] U.S. Cl. ..... 446/239

[58] Field of Search ..... 446/236, 239, 240, 241, 446/246, 266, 102, 113

[56] References Cited

U.S. PATENT DOCUMENTS

| | | | |
|---|---|---|---|
| 3,194,558 | 7/1965 | Fowler, Jr. | 446/239 X |
| 3,382,605 | 5/1968 | Compton | 446/240 |
| 4,012,864 | 3/1977 | Lister | 446/239 X |
| 4,052,982 | 10/1977 | Ozeryansky | 446/236 X |
| 4,352,255 | 10/1982 | Warehime | 446/102 X |

FOREIGN PATENT DOCUMENTS

| | | | |
|---|---|---|---|
| 632851 | 12/1961 | Canada | 446/239 |
| 2504143 | 5/1976 | Fed. Rep. of Germany | 446/239 |

*Primary Examiner*—Robert A. Hafer
*Assistant Examiner*—D. Neal Muir

[57] ABSTRACT

A rotary device is provided and consists of an activator which when rubbed over notches causes vibration in an elongated holder which in turn causes rotation of a prop.

1 Claim, 7 Drawing Figures

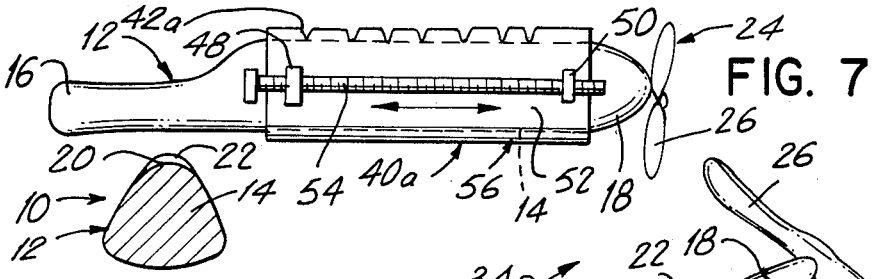
FIG. 7
FIG. 2
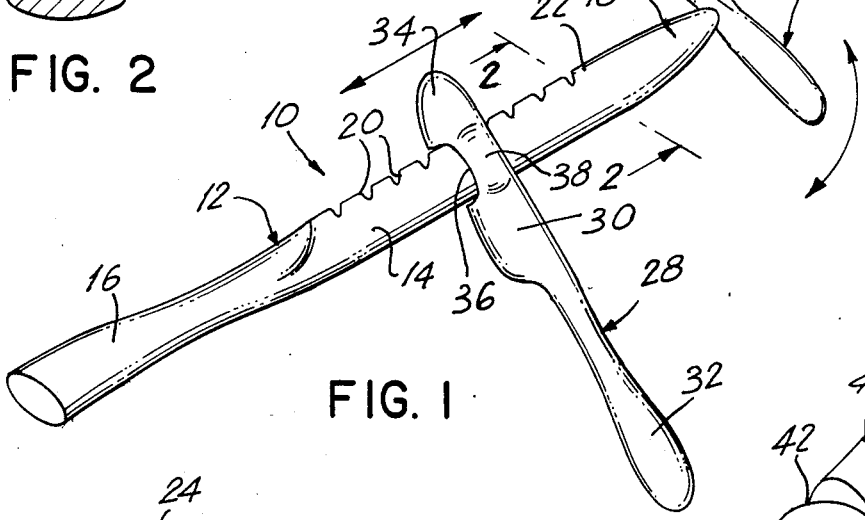
FIG. 1
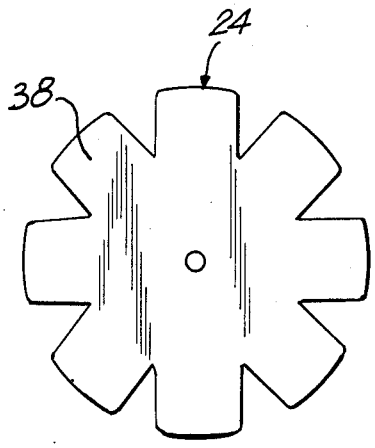
FIG. 3
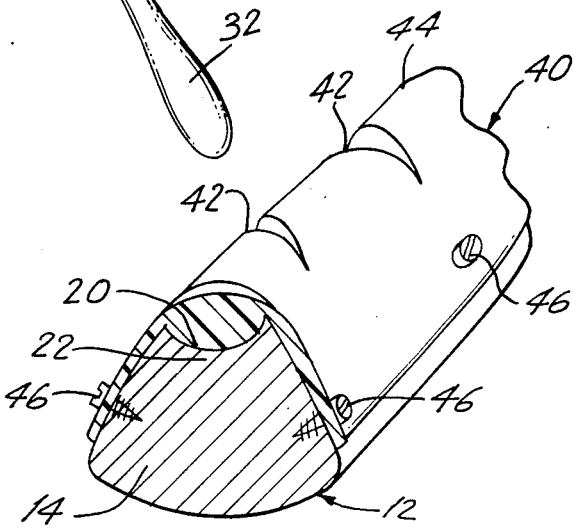
FIG. 4
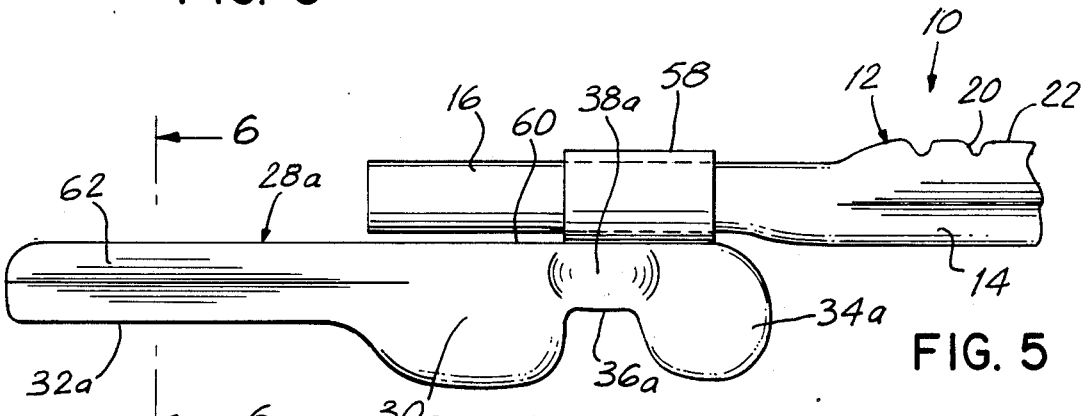
FIG. 5
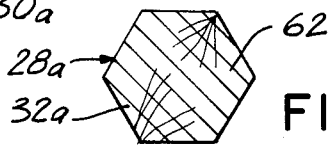
FIG. 6

ROTARY DEVICE

BACKGROUND OF THE INVENTION

The instant invention relates generally to amusement toys and more specifically it relates to a rotary device.

Numerous amusement toys have been provided in prior art that are adapted to rotate propellers and the like using the principle of a stick rubbed across notches on another stick having a propeller which will rotate. For example, U.S. Pat. Nos. 2,993,296; 3,382,605 and 3,455,049 all are illustrative of such prior art. While these units may be suitable for the particular purposes to which they address, they would not be as suitable for the purposes of the present invention as heretofore described.

SUMMARY OF THE INVENTION

A principle object of the present invention is to provide a rotary device that will overcome the shortcomings of the prior art devices.

Another object is to provide a rotary device that includes an activator which when rubbed over notches causes vibration in an elongated holder which in turn causes rotation of a prop so that by switching hands when holding both the activator and the elongated holder the prop will rotate in different directions.

An additional object is to provide a rotary device that includes a replaceable sheath to cover worn notches along the elongated holder.

A further object is to provide a rotary device that is simple and easy to use.

A still further object is to provide a rotary device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the invention.

FIG. 2 is a cross sectional view taken along line 2—2 in FIG. 1.

FIG. 3 is an end view of a pin-wheel to substitute the propeller used in FIG. 1.

FIG. 4 is a cross sectional view partially in perspective similar to FIG. 2 showing a modification which is a replaceable sheath to cover worn notches along the elongated holder.

FIG. 5 is a side view with parts broken away of another modification whereby the activator is held to the handle of elongated holder for storage.

FIG. 6 is a cross sectional view of the activator handle being a hexagon which can be rubbed over the notches instead of the activator head.

FIG. 7 is a side view of another modification showing means for varying the notch widths.

DETAILED DESCRIPTION OF THE PREFERRED EMBODIMENTS

Turning now descriptively to the drawings, in which similar reference characters denote similar elements throughout the several views, FIGS. 1 and 2 illustrate a device 10 for converting vibratory pulses into rotary motion.

The device 10 consists of an elongated holder 12 being generally a triangular rod 14 that has a handle 16 formed on one end to be held in one hand of a user (not shown), a nose 18 formed on other end and a series of notches 20 formed in apex 22 of the triangular rod 14.

A prop element 24 which is a propeller 26 is rotatably journaled to the nose 18 of the elongated holder 12. An activator 28 to be held in other hand of the user is for rubbing across the notches 20 thus generating the vibratory pulses through the elongated holder 12 so that the prop element 24 will rotate by reason of the vibratory pulses.

The activator 28 consists of a flat body portion 30 that has a handle 32 formed on one end to be held in the other hand of the user. A head 34 is formed on other end and has a groove 36 therein with a bulge 38 on both sides over the groove 36 for rubbing across the notches 20.

The prop element 24 which is a propeller 26 as shown in FIG. 1 can be replaced with a pin-wheel 38 shown in FIG. 3. It will rotate in the same manner as the propeller 26. If the hands of the user are switched the prop element 24 will rotate in an opposite direction.

FIG. 4 shows a replaceable sheath 40 that has a series of notches 42 formed in apex 44 of the sheath so as to cover worn notches 20 along apex 22 of the triangular rod 14 of the elongated holder 12. The sheath 40 can be secured to the triangular rod 14 by screws 46.

FIG. 7 shows a modified replaceable sheath **40*a* further containing a pair of spaced apart flanges 48 and 50 mounted to same side 52 of the sheath 40*a* near each end thereof. An elongated adjustment bolt 54 is rotatably affixed within flange 48 while threadably engages other flange 50. When the bolt 54 is turned in one direction the sheath 40*a* will compress causing width of the notches 42*a* to compress. When the bolt 54 is turned in opposite direction the sheath 40*a* will expand causing width of the notches 42*a* to expand. The sheath 40*a* is a hollow flexible tube 56 which slips over the triangular rod 14 of the elongated holder 12**.

FIG. 5 shows a modified activator **28*a* which further contains a hollow tube 58 mounted to edge 60 of the flat body portion 30*a* opposite the groove 36*a* in the head 34*a*. The hollow tube 58 can slip onto the handle 16 of the elongated holder 12** for storage.

The handle **32*a* of the activator 28*a* is a hexagon 62 in cross section (see FIG. 6) which can be rubbed over the notches 20 of the elongated holder 12 instead of the activator head 34*a***.

The device 10 can be fabricated out of plastic, wood, metal, or any other durable material.

While certain novel features of this invention have been shown and described and are pointed out in the annexed claim, it will be understood that various omissions, substitutions and changes in the forms an details of the device illustrated and in its operation can be made by those skilled in the art without departing from the spirit of the invention.

What is claimed is:

1. A device for comverting vibratory pulses into rotary motion, which comprises:

(a) an elongated holder being generally a triangular rod having a handle formed on one end to be held in one hand of a user, a nose formed on other end and a series of notches formed in apex of said triangular rod;

(b) a prop element rotatably journaled to said nose of said elongated holder; and (c) an activator to be held in other hand of said user for rubbing across said notches thus generating said vibratory pulses through said elongated holder so that said prop element will rotate by reason of said vibratory pulses, wherein said activator comprises a flat body portion having a handle formed on one end to be held in said other hand of said user and a head formed on other end having a groove therein with a bulge on both sides over said groove for rubbing across said notches, further comprising a replaceable sheath having a series of notches formed in apex of said sheath so as to cover worn notches along apex of said triangular rod of said elongated holder, wherein said replaceable sheath further comprises:

(d) a pair of spaced apart flanges, each of said flanges mounted to same side of said sheath near each end thereof; and (e) an elongated adjustment bolt rotatably affixed within one of said flanges while threadably engaging other of said flanges so that when said bolt is turned in one direction said sheath will compress causing width of said notches to expand.

* * * * *